US005875589A

United States Patent [19]

Lai et al.

[11] Patent Number: 5,875,589

[45] Date of Patent: Mar. 2, 1999

[54] STRUCTURES HAVING DAMPED FLOORS AND A METHOD OF DAMPING FLOORS

[75] Inventors: Ming-Lai Lai, Lake Elmo; Haregoppa S. Gopalakrishna, Woodbury, both of Minn.

[73] Assignee: Minnesota Mining and Manufacturing Company, St. Paul, Minn.

[21] Appl. No.: 763,272

[22] Filed: Dec. 10, 1996

[51] Int. Cl.[6] ..... E04B 1/98

[52] U.S. Cl. ..... 52/1; 52/167.1; 52/741.3; 52/741.1

[58] Field of Search ..... 52/167.1, 167.6, 52/1, 741.3, 167, 3, 741.1

[56] References Cited

U.S. PATENT DOCUMENTS

| | | | |
|---|---|---|---|
| 3,418,768 | 12/1968 | Cardan | 52/167.1 |
| 3,605,953 | 9/1971 | Caldwell et al. . | |
| 3,691,712 | 9/1972 | Bowling et al. . | |
| 4,039,050 | 8/1977 | Bowling et al. . | |
| 4,615,157 | 10/1986 | Murray . | |
| 4,910,929 | 3/1990 | Scholl | 52/167.3 |
| 5,065,552 | 11/1991 | Kobori et al. | 52/1 |
| 5,147,018 | 9/1992 | Kobori et al. . | |
| 5,259,159 | 11/1993 | Kawase et al. . | |
| 5,327,392 | 7/1994 | Yano et al. | 52/167.1 |
| 5,349,794 | 9/1994 | Taga | 52/167.1 |
| 5,386,671 | 2/1995 | Hu et al. | 52/167.3 |
| 5,533,307 | 7/1996 | Tsai et al. | 52/167.1 X |
| 5,630,298 | 5/1997 | Tsai et al. | 52/167.1 X |

FOREIGN PATENT DOCUMENTS

| | | | |
|---|---|---|---|
| 4-19344B | 3/1992 | Japan . | |
| 405231473 | 9/1993 | Japan | 52/167.1 |
| 406026236 | 2/1994 | Japan | 52/167.1 |
| 6-49923A | 2/1994 | Japan . | |
| 6049924A | 2/1994 | Japan . | |
| 406307118 | 11/1994 | Japan | 52/167.1 |
| 8-68132A | 3/1996 | Japan . | |

OTHER PUBLICATIONS

Fredric Nelson, "The Use of Visco Elastic Material to Damp vibration in Buildings and Large Structures," *AISC Engineering Journal*, Apr. 1968, pp. 72–78.

Tso Chein Pan, "Vibration Pedestrian Overpass," *Journal of Performance of Constructed Facilities*, Vol. 6, No. 1, Feb. 1992.

3M Product & Information Data sheet, Scotchdamp™ Vibration Control Systems, No. 70–0703–7536–8(73.4)RI, Industrial Tape & Specialities Division.

Chang et al., "Viscoelastic Dampers As Energy Dissipation Devices for Seismic Applications," *Earthquake Spectra*, Vol. 9, No. 3, 1993, pp. 371–387.

"Manual of Steel Construction Allowable Stress Design," 9th Ed., American Institute of Steel Construction, Inc., pp. 1–20 and 1–21.

*Primary Examiner*—Robert Canfield

[57] ABSTRACT

A method of damping floor vibrations and structures having damped floors is provided. Damping article(s) are attached to structural floor (A) (at a floor attachment location) and to at least two anchor attachment locations independently selected from the group consisting of locations on structural beams, structural columns, structural beam(s)/structural column intersection(s); and area(s) of a ground floor/structural floor (which may or may not be the same as structural floor (A)) within about one meter of a column and/or beam.

38 Claims, 7 Drawing Sheets

STRUCTURES HAVING DAMPED FLOORS AND A METHOD OF DAMPING FLOORS

FIELD OF THE INVENTION

The present invention relates to structures having damped floors and a method of damping floor vibrations. Typically, the floor(s) damped are those other than ground floors.

BACKGROUND OF THE INVENTION

Typically in a building structure the loads from the building contents are supported by floor(s). Each floor in turn transfers the load to the beams or walls on which it is supported. The loads from the beams are transferred to columns and thereby to foundations. In some cases the walls directly transfer the load to the foundation underneath. A building may consists of several stories and many bays. Typically the loads from a bay are directly transferred to beams or walls and do not or only slightly affect the neighboring bays.

The floors are typically constructed out of wood, concrete, steel or combinations thereof For a wooden floor the wooden planks are typically supported on wooden joists like in the residential homes. A concrete floor typically includes a concrete slab having reinforcing rods embedded therein. In a composite floor system, the corrugated steel deck is supported by the joists and the corrugated steel deck supports the concrete slab. Prefabricated, prestressed, double "T" girder sections are also used as a floor system in industrial and commercial buildings. A floor refers to the combination of load carrying members such as the joists, deck and slab.

Besides carrying the stationary loads, floors also support dynamic loads such as machinery in operation in manufacturing plants, pedestrians in residential and commercial buildings, moving objects such as fork lifts on plant floors and vehicles on parking ramps, dancers in ballrooms, and exercisers in gymnasiums. In some cases a fluid flowing through a pipe or air flowing through a duct may be a source of a dynamic load. At times the floors are constructed using lighter joists and thinner floor slabs which makes the structure flexible. Additionally the span of each bay may be longer for cost advantages and/or multipurpose functions. This results in flexible floor systems with low inherent damping. In such situations the natural resonance of the floor may be excited, due to dynamic loads, leading to floor serviceability problems. The occupants may feel the vibrations and become annoyed or disturbed. In some cases the floor may support precision equipment, e.g., microscopes, where the serviceability problem may be severe. In some instances the building may be unsafe because of the floor vibration. It has been a challenge for the design engineers to either retrofit or design the floor to minimize the vibration problem.

Attempts which have been made in the past to reduce these floor vibrations may be classified into three categories.

First, vibration has been reduced by stiffening the floor using joists, steel and concrete beams.

Second, tuned mass dampers have been used to reduce floor vibrations. A tuned mass damper is a spring, mass and damping element system which is typically attached to the vibrating floor. The resonant frequency of the tuned mass damper is approximately the same as that of the floor. When the floor vibrates, the tuned mass damper is also excited and produces a counteracting force to the floor. The vibrational energy is dissipated through the motion in the damping device of the tuned mass damper. Hosono et al, Japanese patent No. 4[1992]-19344B, discloses a tuned mass damper for floor vibration damping. The damper includes an added mass and a spring with damping properties. The natural frequency of the damper is tuned to the natural frequency of the floor slab. The damper can be hung underneath the floor or set upon the floor.

Third, energy dissipating dampers have been used to reduce floor vibrations. Energy dissipating dampers are conventionally used in structures such as buildings, bridges, water towers, etc., to reduce the effect of vibration due to wind, earthquakes, etc. However, these are also used for reducing the vertical vibrations such as in the structural floors.

Yamanaka, Japanese Patent No. HO-6049924A, discloses a pair of support braces of which one end of one brace is connected to a column while one end of the other brace is connected to a floor. The pair of the support braces is made up of two components joined by a rotational cup and ball joint. Viscoelastic material is used between the cup and ball. Floor movement causes relative rotation between the cup and ball resulting in energy dissipation in the viscoelastic material. Since the rotation between the cup and ball is very small, this damper will not be efficient in dissipating the floor vibration.

Ikehara et al, Japanese patent No. 8-68132A, discloses a damper that consists of an external pipe raised straight from the lower structural floor and an internal pipe hangs from the structural floor above. Between the two pipes is a gap filled with the viscous fluid or viscoelastic material. This damper can attenuate the sound and vibration in both upper and lower floors. One drawback of this type of damper is that it can also transmit vibration between the two floors.

Yamanaka, Japanese Patent No. H06-49923A, discloses a damper having a lower steel tube and upper steel tube forming a gap between the tubes filled with a viscoelastic material. The tubes are attached straight up and down between floors to reduce the floor vibration. Again, one drawback of this type of damper is that it can also transmit vibration between the two floors.

Murray, U.S. Pat. No. 4,615,157, discloses a frictional damper for damping the joist of a floor spanning two supports. The frictional damper has a pair of overlapping plates. One of the plates is secured to the joist to be damped and the other plate is secured directly or indirectly to the ground. The friction between the overlapping plates acts to damp any oscillations in the joist. A friction material may be sandwiched between the plates.

Constrained layer damping is discussed by Fedric Nelson in "The Use of Visco Elastic Material to Damp Vibration in Buildings and Large Structure", AISC Engineering Journal, April 1968. In this paper a method to apply a constrained layer damping to a floor joist is proposed.

A brace viscoelastic damper in which the viscoelastic damper is installed inside the truss joist of a brace is disclosed by Tso Chein Pan, "Vibration of Pedestrian Overpass" Journal of Performance of Constructed Facilities, Vol 6, No. 1, February 1992.

SUMMARY OF THE INVENTION

The present invention provides a method of damping floor vibrations. The method of damping floor vibrations comprises a step of attaching at least one article between a structural floor (A) of a structure at a location identified as a floor attachment location, and at least two locations of the structure identified as anchor attachment locations, wherein each anchor attachment location is independently selected from the group consisting of locations on (a) structural beams, (b) structural columns, (c) structural beam(s)/structural column intersection(s); (d) area(s) of a ground floor which are within about one meter of a structural column and/or structural beam; and (e) area(s) of a structural floor which are within about one meter of a structural column and/or structural beam, wherein the structural floor of (e) may or may not be the same structural floor as the structural floor (A), wherein each article is positioned beneath the structural floor (A) which it is to damp;

wherein each article independently comprises:

(i) two outer rigid members;

(ii) at least one layer of a vibration damping material bonded between the two outer rigid members;

(iii) optionally one or more inner rigid members, positioned interior to the outer rigid members, wherein each rigid member in the article is separated from another rigid member by at least one layer of vibration damping material to which it is bonded; and (iv) optionally a layer(s) of adhesive bonded between any of the rigid members and vibration damping material layer(s);

wherein said outer rigid members and said inner rigid member(s), if present, have shear moduli greater than the vibration damping material layer(s);

wherein each article is constructed and attached to the structure such that the article at least partially dissipates vertical floor vibration energy when the structural floor (A) vibrates.

The present invention also provides a damped structure comprising:

a structure having at least one article attached between a structural floor (A) of the structure at a location identified as a floor attachment location, and at least two locations on the structure identified as anchor attachment locations, wherein each anchor attachment location is independently selected from the group consisting of locations on (a) structural beams, (b) structural columns, (c) structural beam(s)/structural column intersection(s); (d) area(s) of a ground floor which are within about one meter of a structural column and/or structural beam; and (e) area(s) of a structural floor which are within about one meter of a structural column and/or structural beam, wherein the structural floor of (e) may or may not be the same structural floor as the structural floor (A), wherein each article is positioned beneath the structural floor (A) which it is to damp;

wherein each article independently comprises:

(i) two outer rigid members;

(ii) at least one layer of a vibration damping material bonded between the two outer rigid members;

(iii) optionally one or more inner rigid members, positioned interior to the outer rigid members, wherein each rigid member in the article is separated from another rigid member by at least one layer of vibration damping material to which it is bonded; and (iv) optionally a layer(s) of adhesive bonded between any of the rigid members and vibration damping material layer(s);

wherein said outer rigid members and said inner rigid member(s), if present, have shear moduli greater than the vibration damping material layer(s);

wherein each article is constructed and attached to the structure such that the article at least partially dissipates vertical floor vibration energy when the structural floor (A) vibrates.

Various preferred embodiments of the method and damped structure of the invention are discussed below.

The number of anchor attachment locations for each article preferably ranges from two to four, most preferably four.

Preferably, the anchor attachment locations are independently selected from the group consisting of structural beams, structural columns, and structural beam(s)/structural column intersections, most preferably structural beam(s)/structural column intersections.

Preferably, the floor attachment location for at least one article is substantially centrally located (more preferably, centrally located) within structural floor (A).

Preferably, at least one article is attached such that it is in the vicinity of an antinode of one of the first five modes when the structural floor (A) is subject to vibration.

Preferably, the floor attachment location and at least two of the anchor attachment locations for at least one article fall on a straight line when viewed from a position directly above the floor attachment location for damping performance reasons.

Preferably, two or more alternating rigid members of the article are attached via a rigid connecting piece which does not extend through any vibration damping material layer.

Preferably, for at least one article the total number of outer rigid members plus inner rigid members of the article is four or greater, wherein the rigid members of the article can be identified as a first alternating series of odd-numbered rigid members and optionally a second alternating series of even-numbered rigid members and wherein one or both of the following of (i) and (ii) is true:

(i) two or more alternating rigid members of the first odd-numbered series are attached to each other along a first end of the article via a first rigid connecting piece, which first rigid connecting piece does not extend through any vibration damping material layer;

(ii) two or more alternating rigid members of the second even-numbered series are attached to each other along a second end of the article via a second rigid connecting piece, which second rigid connecting piece does not extend through any vibration damping material layer, wherein the second end of the article is positioned opposite the first end of the article.

Preferably, each article is attached to each anchor attachment location and the floor attachment location via a separate rigid attaching element, wherein each rigid attaching element is attached directly to a rigid member of the article or to a rigid connecting piece, which connects two or more alternating rigid members of the article.

In a preferred embodiment each rigid attaching element which attaches the article to the anchor attachment locations is attached to a rigid connecting piece on one side of the article and each rigid attaching element which attaches the article to the floor attachment location is attached to a rigid connecting piece on the opposite side of the article.

Preferably, the rigid attaching elements are selected from the group consisting of straight, curved, and angled rigid attaching elements.

Preferably, the rigid attaching elements which attach the article to anchor attachment locations are selected from the group consisting of straight, curved and angled rigid attaching elements. In some cases the rigid attaching elements are more preferably selected from the group consisting of curved and angled rigid attaching elements.

Preferably, the structure is selected from the group consisting of parking ramps, shopping malls, dwellings, office buildings, hospitals, airport terminals, stores, stadiums, arenas, theaters, schools, gymnasiums, dance halls, commercial office buildings, manufacturing plants, and platforms.

The present invention can provide the floor with added stiffness and damping using the equations provided later herein and does not require the very tedious task of tuning the frequency associated with the tuned mass damper to damp the floor vibration.

The use of at least two anchor attachment locations can provide a stable and efficient means of obtaining stiffness to support the article. Since the anchor attachment locations are usually rigid and do not vibrate, the added stiffness and damping by the article is maximized. The anchor attachment locations are selected in such a way that the vibration from one floor is not transmitted into the floor above or below through the damper. A drawback of the prior art damping systems is that the vibrations could be transmitted to the floor above or below since the anchor locations were selected to be in the center of the floor below or above the floor to be damped. The anchor attachment locations of the present invention can be arranged in such a way that the rigid attaching elements and the article will take up a minimal amount or no floor space.

DETAILED DESCRIPTION OF THE NVENTION

Rigid Members

Figure 1:
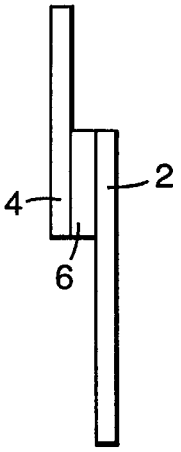
FIG. 1 illustrates a side elevational view of a portion of an embodiment of an article useful in damping floors according to the present invention.

The rigid members which make up the damping article can be formed from a variety of materials depending upon the desired application of the article. The rigid member may be formed from a material including but not limited to those selected from the group consisting of metals, such as steel, stainless steel, copper, aluminum, etc.; metal alloys; plastics; fiber reinforced composites; and woods. Typically the rigid member is formed from a metallic material such as steel or stainless steel.

The rigid member may have a variety of shapes including but not limited to those selected from the group consisting of plates (such as curved plates, flat plates, etc.), bars, rods, tubes, T-beams, and I-beams. Typically the rigid members are in the form of plates, most typically plates that are rectangular in shape. A rigid member may be a one-piece member, or two or more pieces attached together (by welding, for example).

The outer (and inner, if present) rigid members each typically have a shear modulus greater than that of the vibration damping layer(s) which also make up the damping element. The rigid member typically has a shear modulus at least about 10 times greater than that of the vibration damping material layer(s), preferably at least about 100 times greater.

The thickness of the rigid members can vary depending upon the desired application of the article. Typically, the thickness of each rigid member ranges from about 1/16 inch (1.5 mm) to about 1 inch (25 mm), preferably about 1/8 inch (3 mm) to about 0.5 inch (13 mm).

If a rigid member is too thin the following problems can occur: reduced strength of the rigid member, buckling and/or failing of the rigid member when the rigid member is subjected to large forces. If a rigid member is too thick the damping article becomes heavier than necessary.

The length and width of the rigid members can vary. Typically the width of a rigid member ranges from about 0.5 inches (13 mm) to about 10 inches (254 mm), more typically from about 1 inch (25 mm) to about 5 inches (127 mm). The length of a rigid member typically ranges from about 1 inch (25 mm) to about 24 inches (610 mm).

Vibration Damping Material Layers

A vibration damping material layer may be continuous or discontinuous. A continuous vibration damping material layer may comprise one type of damping material or may comprise adjacent sections of different vibration damping materials, for example. A discontinuous layer may comprise sections of vibration damping material separated by non-damping material(s) or space(s), for example. In addition when at least two vibration damping material layers are present each layer may comprise the same or different (chemically, for example) vibration damping material(s).

The vibration damping material comprises a viscoelastic material. A viscoelastic material is one that is viscous, and therefore capable of dissipating energy, yet exhibits certain elastic properties, and therefore capable of storing energy at the desired temperature and frequency range. That is, a viscoelastic material is an elastomeric material typically containing long-chain molecules that can convert mechanical energy into heat when they are deformed. Such a material typically can be deformed, e.g., stretched, by an applied load and gradually regain its original shape, e.g., contract, sometime after the load has been removed.

Suitable viscoelastic materials for use in the vibration damping materials of the present invention have a shear storage modulus G', i.e., measure of the energy stored during deformation, of at least about 1 psi ($6.9\times10^3$ Pascals) at the operating temperature and frequency (typically about −20° C. to 40° C. and about 0.1 Hz to 15 Hz). The storage modulus of useful viscoelastic materials can be as high as 10,000 psi ($6.9\times10^7$ Pascals); however, typically it is about 10–2000 psi ($6.9\times10^4$–$1.4\times10^7$ Pascals).

Suitable viscoelastic materials, at the operating strain temperature and frequency, for use in the vibration damping materials of the present invention have a loss factor $\eta$, i.e., the ratio of energy loss to energy storage or the ratio of the shear loss modulus G" to shear storage modulus G', of at least about 0.1. Preferably the loss factor is at least about 0.5, more preferably greater than about 0.8 at the operating strain frequency and temperature experienced by the material. This loss factor represents a measure of the energy dissipation of the material and depends on the frequency and temperature experienced by the damping material. For example, for 3M™ viscoelastic material SJ2015X Type 110, a crosslinked acrylic polymer, at a shear strain of 5%, frequency of 1 Hz, the loss factor at 68° F. (20° C.) is about 1.3, while at 158° F. (70° C.) the loss factor is about 1.0.

The stiffness of a vibration damping material layer in shear is calculated as follows:

$$k = k' + jk'' \tag{20}$$

$$= \frac{G'A}{h} + j\frac{G''A}{h} \tag{30}$$

where k=complex stiffness of the damping material layer k'=storage stiffness of the damping material layer k"=loss stiffness of the damping material layer $j=\sqrt{-1}$ G'=storage shear modulus of the damping material layer G"=loss shear modulus of the damping material layer A=shear area of the damping material layer h=thickness of the damping material layer Useful vibration damping materials can be isotropic as well as anisotropic materials. As used herein, an "anisotropic material" or "nonisotropic material" is one in which the properties are dependent upon the direction of measurement. Suitable materials having viscoelastic properties include urethane rubbers, silicone rubbers, nitrile rubbers, butyl rubbers, acrylic rubbers, natural rubbers, styrene-butadiene rubbers, and the like. Other useful damping materials include polyesters, polyurethanes, polyamides, ethylene-vinyl acetate copolymers, polyvinyl butyral, polyvinyl butyral-polyvinyl acetate copolymers, epoxy-acrylate interpenetrating networks and the like. Thermoplastics and thermosetting resins suitable for use as vibration damping material may also be utilized in the manufacture of damping articles.

The preferred viscoelastic material is 3M™ SJ2015X acrylic viscoelastic polymer, types 110, 112 and 113 available from 3M, St. Paul, Minn., and described in 3M Product Information and Performance Data sheet, Scotchdamp™ Vibration Control Systems, No. 70-0703-7536-8(73.4)R1 from 3M Industrial Tape and Specialties Division.

Viscoelastic materials are temperature sensitive. Specifically, Chang et al., "Viscoelastic Dampers as Energy Dissipation Devices for Seismic Applications" in *Earthquake Spectra*, Vol. 9, No. 3 (1993) pp. 371–387, noted that an increase in temperature softens the viscoelastic material and the damping efficiency of the material decreases. Additional temperature sensitivity information on 3M™ viscoelastic material SJ2015X acrylic viscoelastic polymer, types 110, 112, and 113 is provided in the above-referenced 3M Product Information and Performance Data sheet. Accordingly, temperature changes in the viscoelastic material must be considered when selecting vibration damping material to construct the damping article useful according to the present invention.

Adhesive Layer

In order to facilitate the adhesion of a vibration damping material layer(s) to the rigid members, a layer of adhesive such as an epoxy is preferably provided between the rigid member and a vibration damping material layer(s) to more effectively bond the layers together. The adhesive used should form a bond between the rigid member and the damping layer having greater strength than the strength of the damping layer itself Preferably, a structural adhesive is used.

Typically, an adhesive is considered structural if its shear strength is greater than 1000 psi ($6.9\times10^6$ pascals), preferably greater than 2000 psi ($1.4\times10^7$ pascals), and most preferably greater than 3000 psi ($2.1\times10^7$ pascals).

The adhesive layer is preferably moisture resistant and resistant to any solvents, gases, or chemicals it may come into contact with in its operating environment. In addition, the adhesive layer is preferably resistant to plasticizers or residual solvents which may be contained in the damping material. Preferably, the adhesive layer is more resistant than the vibration damping layer to shear strength decreases with increases in temperature. Typically, both the damping material and the adhesive will soften as their temperatures are increased. A preferred adhesive will have a shear strength which exceeds the shear strength of the damping material at all operating temperatures, typically about −20° C. to about 40° C., more typically about 0° C. to about 40° C., most typically about 15° C. to about 35° C.

Damping Article and Method of Making

The design of the individual damping article can vary. The damping article comprises a first outer rigid member and a second outer rigid member and a layer of vibration damping material there between. The article may optionally further comprise one or more inner rigid members and alternating layers of vibration damping material. The number of alternating layers of vibration damping material and rigid members can vary as long as the structural integrity of the article is maintained. Typically, the total number of rigid members (including both outer and inner rigid members) in an article ranges from about 2 to about 20. The number of layers most desirable for any damping article will depend also on whether or not strain in the damping layer and/or heat build up in the article during operation is a concern. Using rigid members with good thermal conductivity and specific heat or thermally conductive fibrous or particulate materials in the vibration damping material will reduce heat build up in the damping material.

Preferably, the thermal conductivity of the rigid members should be greater than about 0.2 watts/m degrees C, more preferably greater than about 30 watts/m degrees C, and most preferably greater than about 40 watts/m degrees C.

Another factor to consider in determining the number of layers in the damping article is the available thickness of the damping material. For example, if ⅝ inch (15.9 mm) of damping material is required to meet the damping demands and the damping material selected is available in only ⅛ inch (3.18 mm), ¼ inch (6.35 mm), and ½ inch (12.7 mm) thickness, five layers of ⅛ inch (3.18 mm) material may be used in the damping article.

Although the method of preparing the article can vary, a typical process is as follows. First rigid members are provided which typically have been produced to a flatness of about 0.005 inch (0.127 mm) to about 0.025 inch (0.63 mm) for the portion of the surface that will be bonded to the vibration damping material.

Then, a layer of an adhesive such as an epoxy is typically coated onto one surface of the rigid member which is to come into contact with the vibration damping material layer. The thickness of the adhesive layer can vary depending upon the application. Preferably, this adhesive coating is a thin continuous layer. Typically, the adhesive layer has a thickness of about 0.002 inch (0.051 mm) to about 0.050 inch (1.27 mm).

The adhesive layers can be coated by a variety of methods such as spraying, troweling, brushing, etc. Preferably the adhesive is applied to both the rigid member and vibration damping material layer involved in bonding. Care must be taken not to introduce air into the adhesive layer when bringing the layers to be bonded together. Typically, the adhesive layer is coated onto both the rigid member and the damping material layer by a dispensing nozzle which delivers an adhesive shot to the bond surfaces which is spread uniformly over the bond area. The terms "bond surface" and "bond area" and "shear area" are used interchangeably herein. These terms represent the common surface area between two layers which are bonded.

Next, the adhesive coated layer of vibration damping material is placed on top of the adhesive layer on the first rigid member. If the damping material is liquid, it may alternatively be injected or poured into a mold, in which the rigid members of the damping article have been suitably arranged. The vibration damping material is then cured such that the liquid damping material solidifies.

Additionally, it is possible with some damping materials to form a bond between the damping layers and the rigid members through heat and/or pressure. Any bonding method that produces a bond between damping material layers and rigid members of strength exceeding the strength of the damping material itself is an acceptable method of manufacture. The use of an epoxy adhesive is preferred in the manufacture of the damping articles.

Typically, the vibration damping layer has a thickness of about 0.06 inches (1.5 mm) to about 2 inches (50.8 mm). If the vibration damping material layer is too thin, too many damping layers will be needed to keep shear strain at a sufficiently low level to avoid fracture failure in the damping material layers. It is typically desirable from a manufacturing perspective to minimize the required number of damping material layers.

The damping layer itself is typically selected to operate at shear strains up to 100%. Bond strength between a damping material layer and a rigid member should be large enough to withstand maximum operating stress. As such, the overall shear strength of the article should be at least adequate to ensure that the damping material will fail cohesively before any of the bond interfaces delaminate or the adhesive itself fails cohesively.

The damping article is preferably assembled and attached to any rigid piece(s) and/or any rigid attaching element(s) (discussed later herein) with minimal introduction of strain in the damping material layers. The initial strain in the damping material in the damping article, in general, should be below 10%.

The damping article(s) should be positioned within the structure such that mechanical energy applied to the damping article is at least partially dissipated by the damping article.

FIG. 1 illustrates a damping article made up of two outer rigid members 2 and 4, one vibration damping material layer 6, joined via heat bonding.

If the actual load applied to a rigid member is close to the critical buckling load, the rigid member can be thickened, widened, or shortened to increase the critical load.

Rigid Connecting Piece(s)

Rigid connecting piece(s), which can be used to connect rigid members of the damping article, can be formed from a variety of materials depending upon the desired application of the article. A rigid connecting piece may be formed from a material including but not limited to those selected from the group consisting of metals, such as steel, stainless steel, copper, aluminum, etc.; metal alloys; plastics; and woods. Typically a rigid connecting piece is formed from a metallic material such as steel or stainless steel.

A rigid connecting piece may have a variety of shapes including but not limited to those selected from the group consisting of plates (such as curved plates, flat plates, etc.), bars, rods, tubes, and I-beams. Typically the rigid connecting pieces are in the form of plates, most typically plates that are rectangular in shape. A rigid connecting piece may be a one piece member, or two or more pieces attached together (by welding, for example.)

A rigid connecting piece typically has a shear modulus greater than that of the vibration damping layer of the damping article. A rigid connecting piece typically has a shear modulus at least about 10 times greater than that of the vibration damping material layer(s), preferably at least about 100 times greater.

The thickness of a rigid connecting piece can vary depending upon the desired application of the article. Typically, the thickness of each rigid connecting piece ranges from about 1/16 inch (1.5 mm) to about 1 inch (25 mm), preferably about ⅛ inch (3 mm) to about 0.5 inch (13 mm).

If a rigid connecting piece is too thin the following problems can occur: reduced strength of the rigid connecting piece, buckling and/or failing of the rigid connecting piece when the rigid connecting piece is subjected to large forces. If a rigid connecting piece is too thick the damping article becomes heavier than necessary.

The length and width of the rigid connecting pieces can vary. Typically the width of a rigid connecting piece ranges from about 0.5 inches (13 mm) to about 10 inches (254 mm), more typically from about 1 inch (25 mm) to about 5 inches (127 mm). The length of a rigid connecting piece typically ranges from about 1 inch (25 mm) to about 5 feet (1524 mm).

The rigid connecting piece can connect rigid members via one or more of the following: welds, bolts, rivets, screws, adhesive, and the like. Optionally the rigid connecting piece/rigid member(s) may together be of a one piece construction.

Rigid Attaching Element(s)

The rigid attaching elements, which can be used to connect the damping article to its floor attachment location (s) and anchor attachment location(s) can be formed from a variety of materials depending upon the desired application of the article. The rigid attaching elements may be formed from a material including but not limited to those selected from the group consisting of metals, such as steel, stainless steel, copper, aluminum, etc.; metal alloys; plastics; and woods. Typically the rigid attaching elements are formed from a metallic material such as steel or stainless steel.

The rigid attaching elements may have a variety of shapes including but not limited to those selected from the group consisting of plates (such as curved plates, flat plates, etc.), bars, rods, tubes, and I-beams. Typically the rigid attaching elements are in the form of rods or tubes.

The rigid attaching elements typically have a shear modulus greater than that of the vibration damping layer of the damping article. The rigid attaching elements typically have a shear modulus at least about 10 times greater than that of the vibration damping material layer(s), preferably at least about 100 times greater.

The length and width of the rigid attaching elements can vary. Typically the rigid attaching element is a hollow tube such as a square tube having a wall thickness which ranges from about 1/16 inch (1.6 mm) to about 0.5 inch (12.7 mm), more typically from about 1/8 inch (3.2 mm) to about 0.5 inch (12.7 mm). The cross-section of the rigid attaching element typically ranges from about one inch (25.4 mm) by one inch to about 8 inches (203.2 mm) by 8 inches, more typically about 2 inches (50.8 mm) by 2 inches (50.8 mm) and most typically about 4 inches (101.6 mm) by about 4 inches The length of a rigid attaching element typically ranges from about 1 foot (30.48 cm) to about 30 feet (9140 mm) depending on the distance from the article to the attachment locations.

The rigid attaching elements should be attached to the article in a manner that allows the article to damp the floor vibrations. The rigid attaching elements may be attached to the damping article in a variety of ways. They may be attached to the rigid member(s) and/or to rigid connecting piece(s) if present. Typically the rigid attaching element that attaches the article to the floor attachment location is attached to one end of the article and the rigid attachment elements that attach the article to the anchor attachment locations are attached to an opposite end of the article.

The rigid attaching elements can be attached to the rigid article, a rigid connecting piece, and/or its attachment locations via one or more of the following: welds, bolts, rivets, screws, adhesive, and the like.

Design of the Article

When the article is attached between the floor to be damped at the floor attachment location and the anchor attachment locations, the floor will have added stiffness $k'_{add}$ and damping $\zeta_{add}$. The design procedure is an iterative process. The added stiffness $k'_{add}$ can be calculated using Equation (1) from the vertical stiffness contributed by all the rigid attaching elements $k_{rigid}$ and vertical stiffness of the article $k_{art}=k'_{art}+j\eta_{art}k'_{art}$. The symbols $k'_{art}$ and $\eta_{art}$ represent the storage stiffness and loss factor of the article, respectively.

$$\frac{1}{k'_{add}+j\eta_{add}k'_{add}}=\frac{1}{k_{rigid}}+\frac{1}{k'_{art}+j\eta_{art}k'_{art}} \tag{1}$$

where j equals $\sqrt{-1}$ and $\eta_{add}$ is the loss factor for the article-rigid attaching element assembly. For this calculation and the following calculations the rigid connecting piece(s) is considered to be part of the article.

The additional damping ratio $\zeta_{add}$ of the floor can be computed from a simplified equation as $$\zeta_{add}=\frac{\eta_{add}}{2}\quad\frac{k'_{add}}{k'_{add}+k_i} \tag{2}$$

where $k_i$ is the modal stiffness of the floor with the article added at the floor attachment location of the article for vibration mode i, wherein i is an integer of 1 or greater. $\eta_{add}$ can be determined from Equation (1).

The modal stiffness of the article and floor combination at the floor attachment location can be calculated as:

$$k_i=\omega_i^2 m_i \tag{3}$$

where $\omega_i$ is the natural frequency and $m_i$ is the scaled modal mass of the floor at the floor attachment location of the $i^{th}$ vibration mode. $m_i$ can be calculated from $$m_i=\frac{\phi_i^T M\phi_i}{\phi_{iart}^2} \tag{4}$$

where $\phi_i$ is the vector of the vibration mode shape of interest of the floor with the article added, $^T$ represents the vector transpose, $\phi_{iart}$ is the mode shape value at the floor attachment location and M is the mass matrix of the floor. The natural frequency, mode shape and the mass matrix can be obtained when the floor and the article are modeled using the finite element analysis.

The shear area of the damping material can be calculated as $$A=k'_{art}h/G' \tag{5}$$

where h is the thickness of the damping material and G' is the storage modulus of the vibration damping material at the operating conditions and is available from the vibration damping material manufacturers. The thickness of the damping material is chosen to be thick enough so that the damping material will not rupture due to excessive displacement in the damping article.

The present invention may be better understood by referring to the following figures. The floors referred to in the following figures are all structural floors except for those identified as ground floors.

FIG. 1 illustrates an article with outer rigid members 2 and 4 and interior vibration damping material layer 6.

Figure 2:
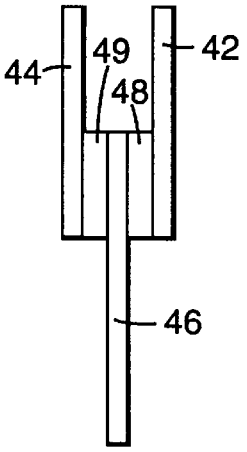
FIG. 2 illustrates a side elevational view of a portion of another embodiment of an article useful in damping floors according to the present invention.

FIG. 2 illustrates an article with outer rigid members 42 and 44, inner rigid member 46, and interior vibration damping material layers 48 and 49.

Figure 3:
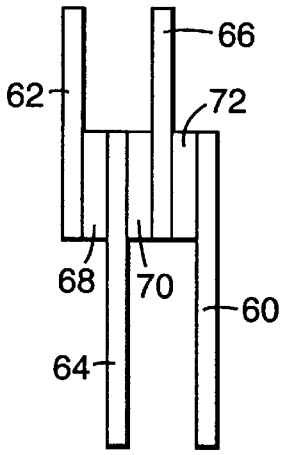
FIG. 3 illustrates a side elevational view of a portion of another embodiment of an article useful in damping floors according to the present invention.

FIG. 3 illustrates an article with outer rigid members 60 and 62, inner rigid members 64 and 66, and interior vibration damping material layers 68, 70, and 72. The rigid members are staggered.

Figure 4:
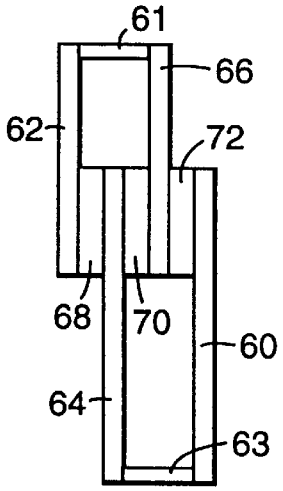
FIG. 4 illustrates a side elevational view of a portion of the article of FIG. 3 plus two rigid connecting pieces.

FIG. 4 illustrates the article of FIG. 3 which has its rigid members 62 and 66 joined via rigid connecting piece 61 and its rigid members 64 and 60 joined via rigid connecting piece 63.

Figure 5:
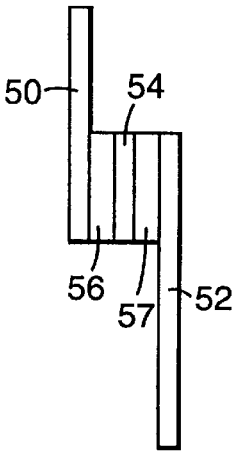
FIG. 5 illustrates a side elevational view of a portion of another embodiment of an article useful in damping floors according to the present invention.

FIG. 5 illustrates an article with outer rigid members 50 and 52, inner rigid member 54, and interior vibration damping material layers 56 and 57.

In FIGS. 1, 2, 3, and 5 the rigid members are positioned substantially parallel to one another in sandwich or laminate type construction wherein in each case at least two of the rigid member extend beyond the damping material in a direction opposite another rigid member. These type of dampers are known as shear dampers.

Figure 6:
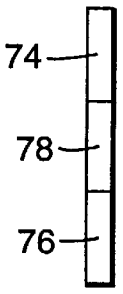
FIG. 6 illustrates a side elevational view of a portion of another embodiment of an article useful in damping floors according to the present invention.
Figure 7:
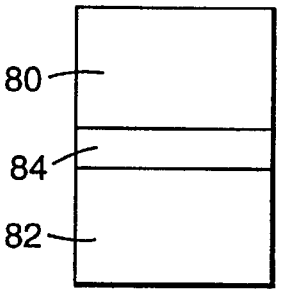
FIG. 7 illustrates a side elevational view of a portion of another embodiment of an article useful in damping floors according to the present invention.

FIGS. 6 and 7 illustrate axial dampers which are tension-compression dampers.

FIG. 6 illustrates an article with outer rigid members 74 and 76 and interior vibration damping material layer 78.

FIG. 7 illustrates an article with outer rigid members 80 and 82 and interior vibration damping material layer 84.

Figure 8:
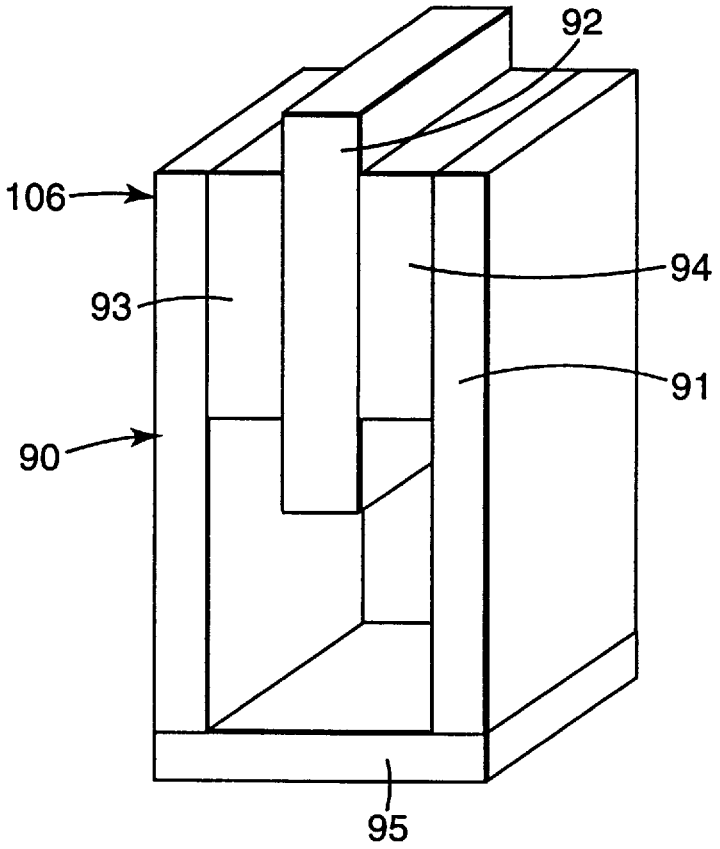
FIG. 8 illustrates a perspective view of the article used to damp the structures of FIGS. 9–13. The article is shown to have a rigid connecting piece attaching the outer rigid members of the article.

FIG. 8 is article 106 present in FIGS. 8, 9, 10, 11 and 12. The article comprises outer rigid members 90 and 91, inner rigid member 92, and vibration damping material layers 93 and 94. The rigid members extend beyond the vibration damping material layers in each direction. Rigid connecting piece 95 is attached between outer rigid member 90 and outer rigid member 91.

Figure 9:
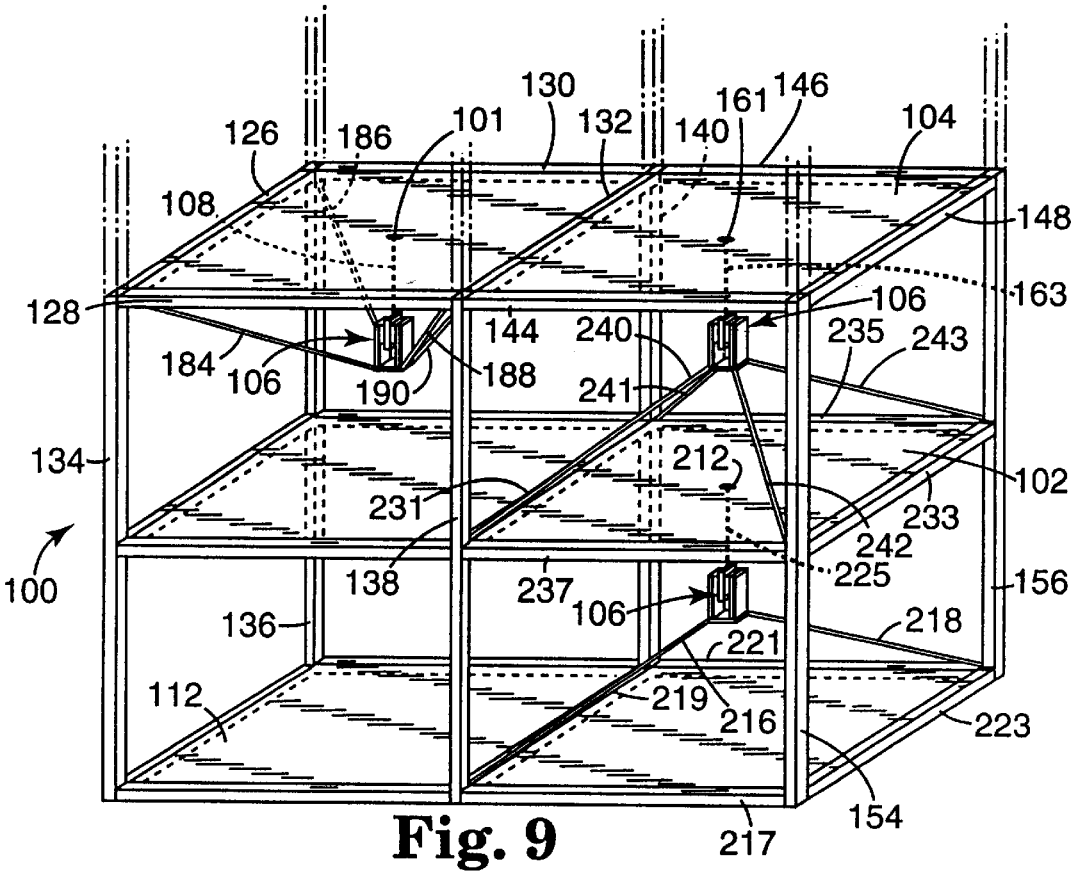
FIG. 9 illustrates a perspective view of a multiple-floor building in which the second and third floors are damped against floor vibrations.

FIG. 9 illustrates a perspective view of a multiple-floor building 100 in which the second 102 and third 104 floors are damped against floor vibrations.

The third floor 104 is damped via two articles 106. The second floor 102 is damped via an article 106 also. The ground floor 112 due to its location does not require damping. Beams 126, 128, 130, 132, 144, 146 and 148 and columns 134, 136, 138, 140, 154, and 156 are shown.

One article 106 damping the third floor 104 has four straight rigid attaching elements 184, 186, 188, and 190 attached to rigid connecting piece 95 (not numbered in FIG. 9) and to the respective anchor attachment locations. One rigid attaching element 184 is attached to the intersection of beams 126 and 128 with column 134. Another rigid attaching element 186 is attached to the intersection of beams 126 and 130 with column 136. Another rigid attaching element 188 is attached to the intersection of beams 128 and 132 with column 138. Another rigid attaching element 190 is attached to the intersection of beams 130 and 132 with column 140. The inner rigid member 92 (not numbered in FIG. 9) of the article 106 is attached to a point on the third floor 104 identified as 101 (the floor attachment location) via rigid attaching element 108.

An article 106 damping the second floor 102 has two straight rigid attaching elements 216 and 218 attached to rigid connecting piece 95 (not numbered in FIG. 9), one at either side thereof. One rigid attaching element 216 is attached to an anchor attachment location which is the intersection of beams 217 and 219 and column 138. The other rigid attaching element 218 is attached to an anchor attachment location which is the intersection of beams 221 and 223 and column 156. The inner rigid member 92 (not numbered in FIG. 9) of the article 106 is attached to a point on the second floor 102 identified as 212 (the floor attachment location) via rigid attaching element 225.

Another article 106 damping the third floor 104 has four straight rigid attaching elements 240, 241, 242 and 243 which are attached to rigid connecting piece 95 (not numbered in FIG. 9), one at either side thereof The rigid attaching element 240 is attached to the intersection of beams 231 and 237 and column 138. The rigid attaching element 241 is attached to the intersection of beams 231 and 235 and column 140. The rigid attaching element 243 is attached to the intersection of beams 233 and 235 and column 156. The rigid attaching element 242 is attached to the intersection of beams 237 and 233 and column 154. The inner rigid member 92 (not numbered in FIG. 8) of the article 106 is attached to a point on the third floor 104 identified as 161 (floor attachment location) via rigid attaching element 163.

Figure 10:
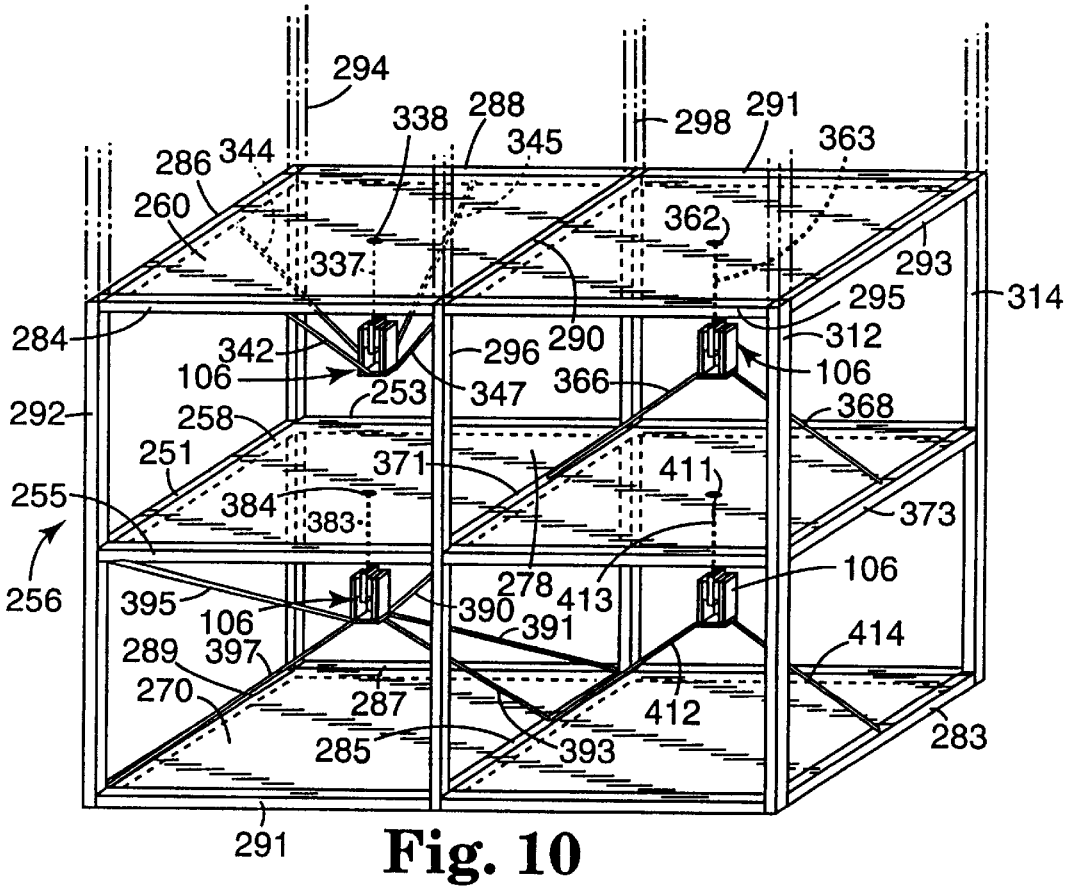
FIG. 10 illustrates a perspective view of a multiple-floor building in which the second and third floors are damped against floor vibrations.

FIG. 10 illustrates a perspective view of a multiple-floor building 256 in which the second 258 and third 260 floors are damped against floor vibrations. The ground floor 270, due to its location, does not require damping. Beams 284, 286, 288, 291, 293, 295 and 290 and columns 292, 294, 296, 312, 314 and 298 are present.

One article 106 damping the third floor 260 has four rigid attaching elements 342, 344, 345, and 347 which are attached to the rigid connecting piece 95 (not numbered in FIG. 10), one at either side thereof and to their respective anchor attachment locations. One rigid attaching element 342 is attached to a midpoint of a beam 284. Another rigid attaching element 344 is attached to a midpoint of a beam 286. Another rigid attaching element 345 is attached to a midpoint of a beam 288. Another rigid attaching element 347 is attached to a midpoint of a beam 290. The inner rigid member 92 (not numbered in FIG. 10) of the article 106 is attached to a point on the third floor 260 identified as 338 (the floor attachment location) via rigid attaching element 337.

Another article 106 damping the third floor 260 has two rigid attaching elements 366 and 368 which are attached to rigid connecting piece 95 (not numbered in FIG. 10), one at either side thereof. One rigid attaching element 366 is attached to an anchor attachment location which is a midpoint of beam 371. The other rigid attaching element 368 is attached to an anchor attachment location which is a midpoint of beam 373. The inner rigid member 92 (not numbered in FIG. 10) of the article 106 is attached to a point on the third floor identified as 362 (floor attachment location) via rigid attaching element 363.

An article 106 damping the second floor has five rigid attaching elements 390, 391, 393, 395 and 397 attached to rigid connecting piece 95 (not numbered in FIG. 10), one at either side thereof. One rigid attaching element 390 is attached to intersecting beams 371 and 253. Another rigid attaching element 391 is attached to intersecting beams 285 and 287. Another rigid attaching element 393 is attached to a midpoint of beam 285. Another rigid attaching element 395 is attached to intersecting beams 251 and 255. Another rigid attaching element 397 is attached to intersecting beams 291 and 289. The inner rigid member 92 (not numbered in FIG. 10) of the article 106 is attached to a point on the second floor identified as 384 via rigid attaching element 383.

Another article 106 damping the second floor 258 has two rigid attaching elements 412 and 414 which are attached to rigid connecting piece 95 (not numbered in FIG. 10), one at either side thereof. One rigid attaching element 412 is attached to a midpoint of beam 285. The rigid attaching element 414 is attached to a midpoint of beam 283. The inner rigid member 92 (not numbered in FIG. 10) of the article 106 is attached to a point on the floor identified as 411 via rigid attaching element 413.

Figure 11:
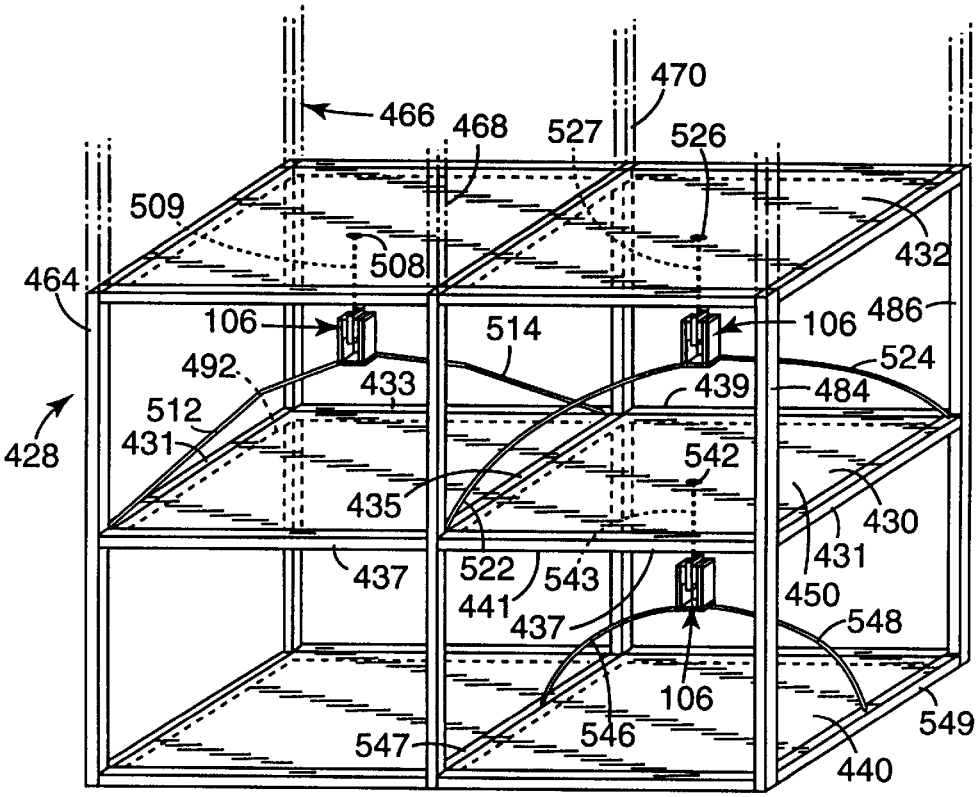
FIG. 11 illustrates a perspective view of a multiple-floor building in which the second and third floors are damped against floor vibrations.

FIG. 11 illustrates a perspective view of a multiple-floor building 428 in which the second 430 and third floors 432 are damped against floor vibrations.

The third floor 432 is damped via two articles 106. The second floor 430 is damped via one article 106. The ground floor 440, due to its location, does not require damping. Columns 464, 466, 468, 484, 486 and 470 are shown.

One article 106 damping the third floor 432 has two angled rigid attaching elements 512 and 514 which are attached to rigid connecting piece 95 (not numbered in FIG. 11), one at either side thereof. One rigid attaching element 512 is attached to the intersection of beams 431 and 437 and column 464. The other rigid attaching element 514 is attached to the intersection of beams 433 and 435 and column 470. The inner rigid member 92 (not numbered in FIG. 11) of the article 106 is attached to a point on the third floor 432 identified as 508 via rigid attaching element 509.

Another article 106 damping the third floor 432 has two curved rigid attaching elements 522 and 524 attached to rigid connecting piece 95 (not numbered in FIG. 11), one at either side thereof. One rigid attaching element 522 is attached to the intersection of beams 435 and 441 and column 468. The other rigid attaching element 524 is attached to the intersection of beams 431 and 439 and column 486. The inner rigid member 92 (not numbered in FIG. 11) of the article is attached to a point on the third floor identified as 526 (the floor attachment location) via rigid attaching element 527.

An article 106 damping the second floor 430 has two curved rigid attaching elements 546 and 548 attached to rigid connecting piece 95 (not numbered in FIG. 11), one at either side thereof. One rigid attaching element 546 is attached to a midpoint of beam 547. Another rigid attaching element 548 is attached to a midpoint of beam 549. The inner rigid member 92 (not numbered in FIG. 11) of the article is attached to a point on the second floor identified as 542 (the floor attachment location) via rigid attaching element 543.

Figure 12:
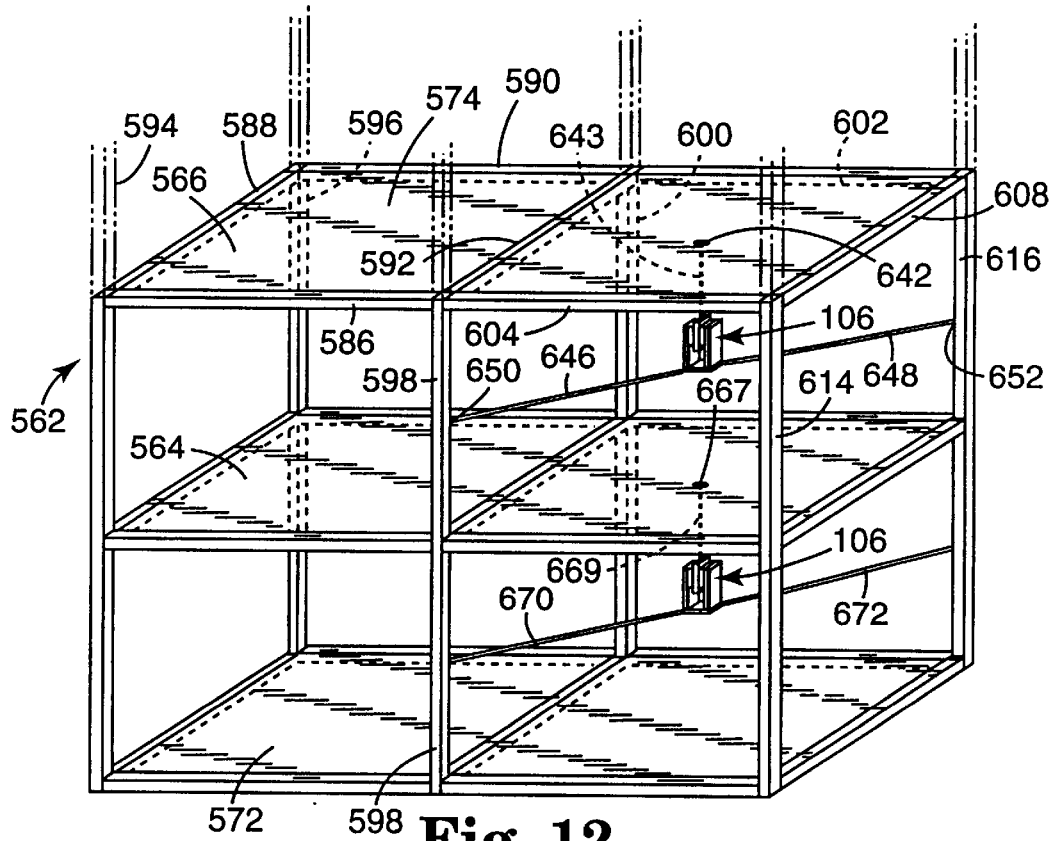
FIG. 12 illustrates a perspective view of a multiple-floor building in which the second and third floors are damped against floor vibrations.

FIG. 12 illustrates a perspective view of a multiple-floor building 562 in which the second 564 and third floors 566 are damped against floor vibrations.

The third floor 566 is damped via an article 106. The second floor 564 is damped via an article 106. The ground floor 572, due to its location, does not require damping. Beams 586, 588, 590, 602, 604, and 608 and 592 and columns 594, 596, 598, 614, 616 and 600 are shown.

One article 106 damping the third floor 566 has two straight rigid attaching elements 646 and 648 which are attached to rigid connecting piece 95 (not numbered in FIG. 12), one at either side thereof. One rigid attaching element 646 is attached to column 598 at anchor attachment location 650. The other rigid attaching element 648 is attached to diagonally opposed column 616 and anchor attachment location 652. The inner rigid member 92 (not numbered in FIG. 12) of the article 106 is attached to a point on the third floor identified as 642 (the floor attachment location) via rigid attaching element 643.

An article 106 damping the second floor 564 has two straight rigid attaching elements 670 and 672 which are attached to rigid connecting piece 95 (not numbered in FIG. 12), one at either side thereof. One rigid attaching element 670 is attached to column 598. Another rigid attaching element 672 is attached to diagonally opposed column 616. The inner rigid member 92 (not numbered in FIG. 12) of the article is attached to a point on the second floor identified as 667 (the floor attachment location) via rigid attaching element 669.

Figure 13:
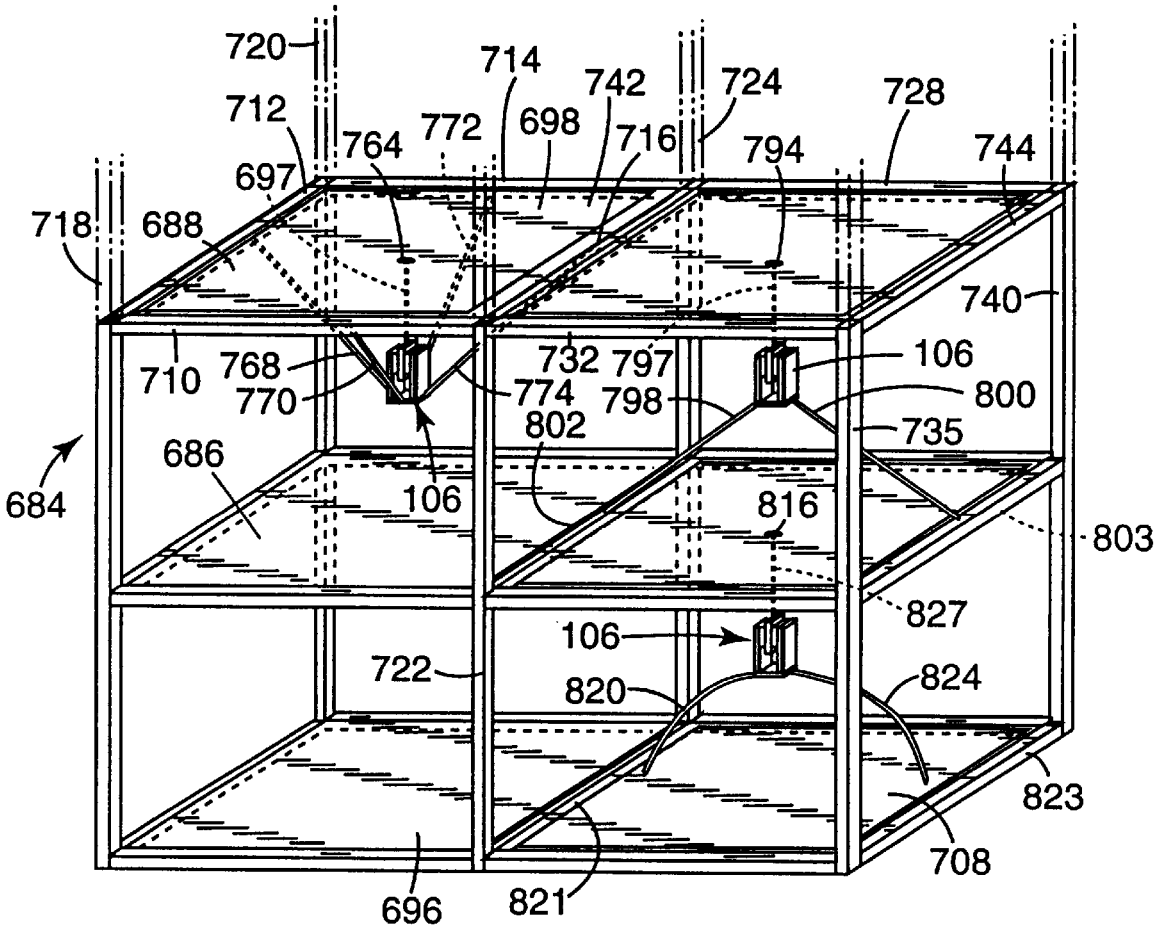
FIG. 13 illustrates a perspective view of a multiple-floor building in which the second and third floors are damped against floor vibrations.

FIG. 13 illustrates a perspective of a multiple-floor building 684 in which the second 686 and third 688 floors are damped against floor vibrations.

The third floor 688 is damped via two articles 106. The second floor 686 is damped via another article 106. The ground floor 696, due to its location, does not require damping. Beams 710, 712, 714, 744, 728, 732 and 716 and columns 718, 720, 722, 735, 740 and 724 are shown.

One article 106 damping the third floor 688 has four rigid attaching elements 768, 770, 772, and 774 which are attached to rigid connecting piece 95, (not numbered in FIG. 13) one at either side thereof. One rigid attaching element 768 is attached to a point which is close to a beam midpoint, but which actually falls on the structural floor within 1 m. of beam 712. Another rigid attaching element 770 is attached to a point which is on the structural floor but which is within 1 m. of beam 710. Another rigid attaching element 772 is attached to a point which is on the structural floor but which is within 1 m. of beam 714. Another rigid attaching element 774 is attached to a point which is on the structural floor but which is within 1 m. of beam 716. The inner rigid member 92 (not numbered in FIG. 13) of the article is attached to a point on the third floor 668 identified as 764 (the floor attachment location) via rigid attaching element 697.

Another article 106 damping the third floor 688 has two straight rigid attaching elements 798 and 800 which are attached to rigid connecting piece 95 (not numbered in FIG. 13), one at either side thereof. One rigid attaching element 798 is attached to a location on a floor within 1 m. of beam 802. The other rigid attaching element 800 is attached to a location on a floor within 1 m. of beam 803. The inner rigid member 92 (not numbered in FIG. 13) of the article is attached to a point on the third floor 688 identified as 794 (the floor attachment location) via rigid attaching element 797.

An article 106 damps the second floor. The inner rigid member 92 (not numbered in FIG. 13) is attached to a point on the second floor identified as 816. Two curved rigid attaching elements 820 and 824 are attached to rigid connecting piece 95 (not numbered in FIG. 13) of the article 106, one at either side thereof. One rigid attaching element 820 is attached to the ground floor within 1 m. of beam 821. Another rigid attaching element 824 is attached to a location on the ground within 1 m. of beam 823. The inner rigid member 92 of the article 106 is attached to a point on the second floor identified as 816 via rigid attaching element 827.

Figure 14:
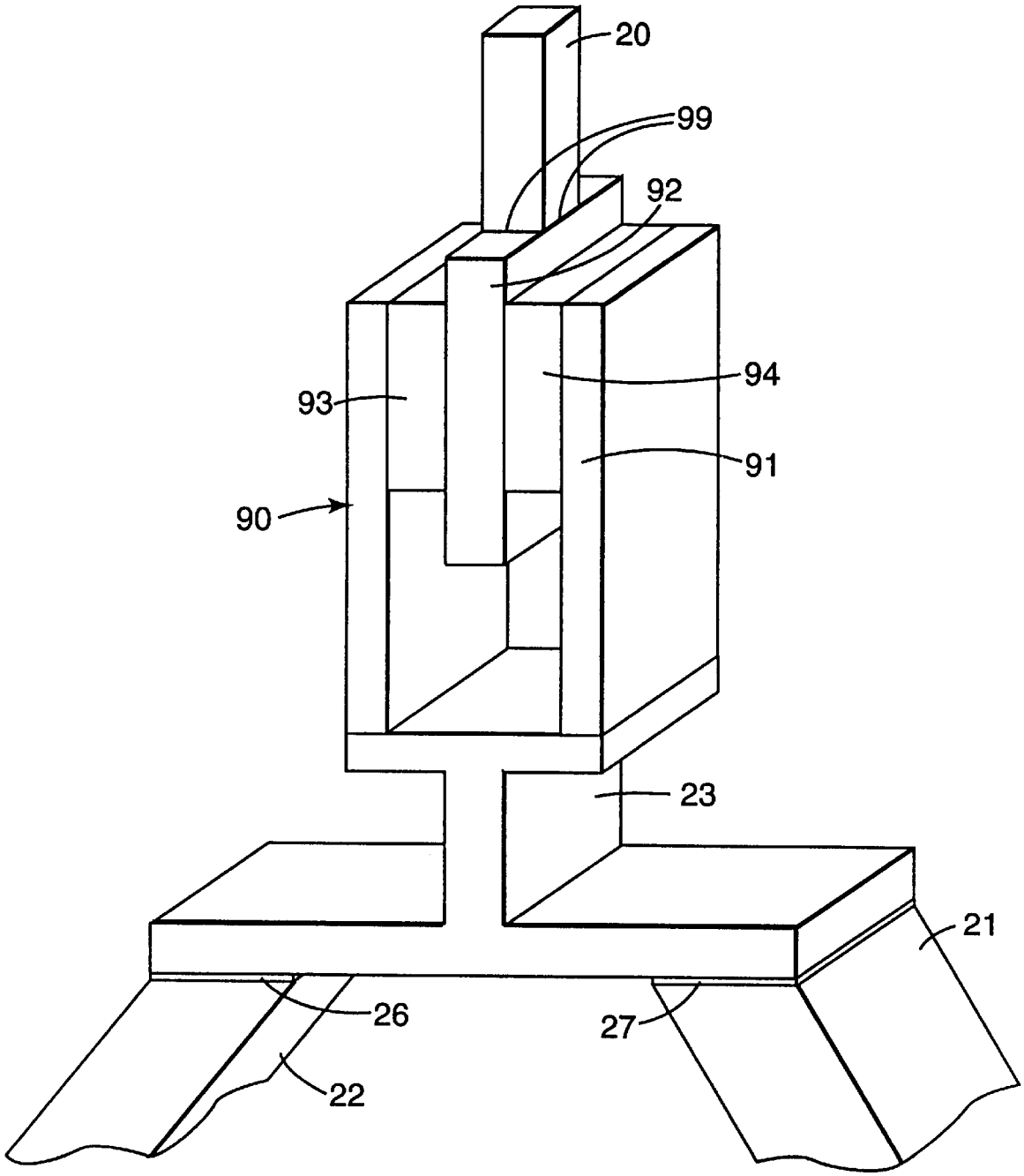
FIG. 14 illustrates a perspective view of the article of FIG. 8 but with a different rigid connecting piece. The figure also shows rigid attaching elements attached thereto.

FIG. 14 illustrates the article of FIG. 8 but with a different rigid connecting piece. FIG. 14 also shows rigid attaching elements attached thereto. One rigid attaching element 20 is attached via welds 99 to inner rigid member 92. The other rigid attaching elements 21 and 22 are attached via welds 26 and 27 to rigid connecting piece 23. Rigid connecting piece 23 is attached to outer rigid members 90 and 91 via adhesive (not shown).

Figure 15:
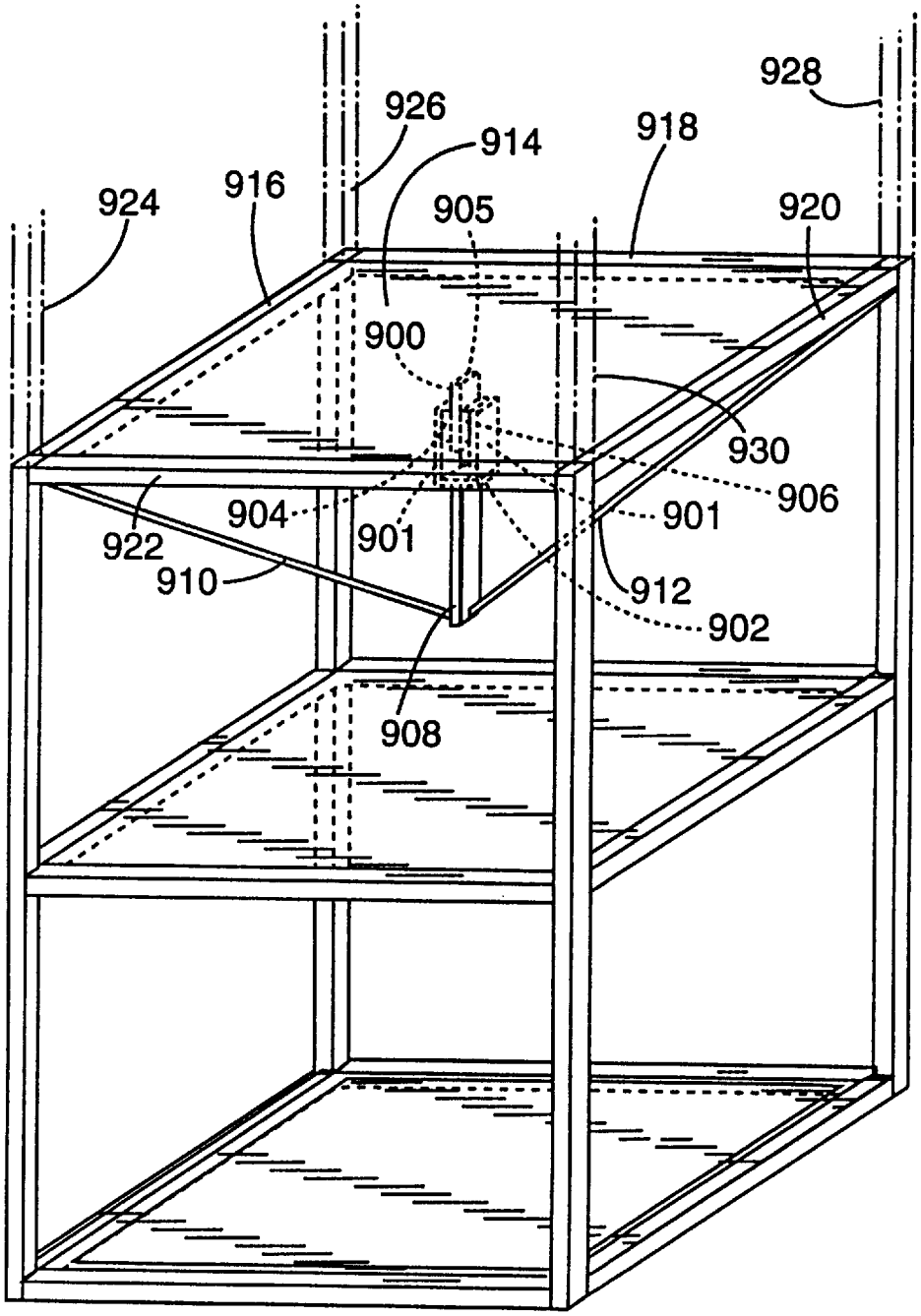
FIG. 15 illustrates a perspective view of a multiple-floor building in which a third floor is damped against floor vibrations The term "structural floor" as used herein in describing the invention refers to the floor formed from the combination of load-carrying members such as slab(s), joist(s), deck(s), etc. Such a floor transfers a load placed thereon onto one or more of the following: structural beams, columns, or walls. The term "ground floor" as used herein in describing the invention refers to the floor wherein a load placed thereon is directly transferred to the ground underneath.

FIG. 15 illustrates a perspective view of a multiple-floor building in which the third floor 914 is damped against floor vibrations. Beams 916, 918, 920, and 922 are shown. Columns 924, 926, 928, and 930 are shown.

The article damping the third floor 914 comprises outer rigid members 901 and 902, inner rigid member 900, and vibration damping material layers 904 and 906. The rigid members extend beyond the vibration damping material layers in each direction. "T" shaped rigid connecting piece 908 is attached between outer rigid member 901 and outer rigid member 902.

Two straight rigid attaching elements 910 and 912 are attached to rigid connecting piece 908, one at either side thereof. One rigid attaching element 910 is attached to a location which is the intersection of beams 916 and 922 with column 924. The other rigid attaching element 912 is attached to a location which is the intersection of beams 918 and 920 with column 928. The inner rigid member 900 of the article is attached to a point on the third floor 914 identified as 905 (the floor attachment location) via welds.

The following Example further illustrates but does not limit the present invention.

EXAMPLE

The structural floor to be damped is a bay of the second floor of a two story building. The planar dimension of the floor is 28 ft×35 ft (8.53 m×10.67 m). The floor has a composite construction, wherein the concrete slab thickness is 2.5 inches (6.35 cm), the corrugated steel deck height is 0.625 inch (1.59 cm), and the joists are truss joists of type 18K4 (described in "Vulcraft Steel Joists and Joist Girders", Vulcraft Company) spaced at 30 inches (76.2 cm) apart. The steel deck is attached to the joists and the joists rest on the edge beam (W21×62 described in "Manual of Steel Construction Allowable Stress Design", 9th Edition, American Institute of Steel Construction, Inc.) on one end and rests on a girder on the other end (36G14N). The span of the joists is equal to 28 feet (8.53 m) and the span of the edge beam and girder is equal to 35 feet (10.67 m). The girder and the beam rest on the columns.

Finite element analysis is used to evaluate the modal parameters, i.e., natural frequencies, mode shapes of the floor described above. The modal mass which is used in Equation 4 is shown in the following table. It should be noted that the modal parameters are calculated herein for the floor without the damping article added as a first approximation. The modal stiffness $k_i$ calculated from the modal parameters will be a first approximation too. An accurate $k_i$ can be recomputed after the article is designed and added to the finite element model. The accurate value of $k_i$ can then be substituted into Equation 2 to provide a more accurate calculation of the added damping ratio $\zeta_{add}$.

| Mode | Frequency Hz | Floor Attachment Location | Modal Mass, Eq. 4, kips (ton) | Modal Stiffness Eq. 3, kips/in, (kN/cm) |
|---|---|---|---|---|
| 1 | 3.97 | Center of Floor to be Damped | 16.9 (7.68) | 27.7 (48.6) |
| 2 | 8.0 | Middle of Girder | 21.63 (9.83) | 141.6 (247.4) |
| 3 | 8.08 | Middle of edge joist | 34.19 (15.54) | 228.3 (398.8) |

From the finite element analysis using ANSYS software (available form ANSYS, Inc., Houston, Pa., USA), the first modal frequency $f_1$, modal mass $m_1$, and modal stiffness $k_1$ calculated from Equations 3 and 4 at the center of the floor becomes $f_1$=3.97 Hz $\omega_1=2\pi\times f_1$ $m_1$=16.9 kip (7.68 ton)

$k_1=(2\pi\cdot 3.97)^2\times 16.9/386=27.7$ kip/in (or 48.6 kN/cm).

As shown in FIG. 9 the article 106 is 1 foot long (30.48 cm) and is attached beneath the floor at the floor attachment location 100 using a 4 feet (121.9 cm) long rigid attaching element 108. From the bottom of the article four anchor rigid attaching elements 184, 186, 188, and 190 connect the bottom of the article 106 to the four column/beam intersections of the floor. Each of these four rigid attaching elements is a 4 inch (10.16 cm) by 4 inch (10.16 cm) square steel tube with a wall thickness ⅛ inch (0.3175 cm) and a length of 22.96 feet (7.0 m).

The vertical stiffness ($k_{anchor}$) of each anchor rigid attaching element (184, 186, 188 or 190) is calculated as:

$$k_{anchor}=\frac{EA_{anchor}}{L_{anchor}}\sin^2\theta_{anchor}=\frac{30\times 10^6(4\times 4-3.75\times 3.75)}{22.96\times 12}\sin^2(12.2^\circ)=9.4\ kip/\text{in}=15.4\ kN/\text{cm}. \quad (5)$$

where E is the Young's modulus of the steel, $A_{anchor}$ is the cross-sectional area of the steel of each rigid attaching element, $L_{anchor}$ is the length of each rigid attaching element and $\theta_{anchor}$ is the angle between the floor surface and each rigid attaching element. The rigid attaching elements can also contribute to vertical stiffness due to bending but they are not considered in this calculation.

The vertical stiffness of the floor rigid attaching element 108 is calculated as:

$$k_{frae}=\frac{EA_{frae}}{L_{frae}}=\frac{30\times 10^{-6}(4\times 4-3.75\times 3.75)}{4\times 12}=1{,}210.9\ kip/\text{in}=1{,}987.5\ kN/\text{cm}, \quad (6)$$

wherein $A_{frae}$ is the cross sectional area of the steel of the floor rigid attaching element and $L_{frae}$ is the length of the floor rigid attaching element. The total vertical stiffness $k_{rigid}$ of all the rigid attaching elements is calculated as:

$$k_{rigid}=\frac{4k_{anchor}k_{frae}}{4k_{anchor}+k_{frae}}=36.5\ kip/\text{in}=58.9\ kN/\text{cm} \quad (7)$$

The 3M brand ISD 110 viscoelastic material with a loss factor $\eta_d$ of 1.2 and storage shear modulus G' of 550 psi ($3.8\times 10^6$ Pascal) at 24° C., 4.7 Hz and 5% strain is used as the vibration damping material for the article. The storage stiffness of the article is $k'_{art}$=14 kip/in (24.6 kN/cm). From Equations 1 and 2, the added stiffness and damping to floor are calculated as $k'_{add}$=12.5 kip/in (21.9 kN/cm)

$\zeta_{add}$=9.8%

The first natural frequency of the floor becomes $$3.96\times\sqrt{\frac{27.7+19.9}{27.7}}=4.7\ \text{Hz}$$

because of the added stiffness from the article-rigid attaching element assembly.

If 0.5 inch (12.7 mm) thick 3M brand ISD 110 viscoelastic material is used as the vibration damping material, the total shear area of the viscoelastic material can be calculated from $$A_{vem}=\frac{k'_{art}h}{G'}=\frac{14{,}000\times 0.5}{550}=12.7\ \text{in}^2=2\times 2.52\ \text{in}\times 2.52\ \text{in}\ (2\times 6.4\ \text{cm}\times 6.4\ \text{cm})$$

Two 6.4 cm by 6.4 cm viscoelastic slabs with one inner rigid member and two outer rigid members are used for the article.

With this design, the stiffness of the article and rigid attaching elements can be used in the finite element analysis to compute the new modal parameters, i.e., mode shape, modal frequency, modal mass and then the modal stiffness. Equation 2 is used with the new modal stiffness $k_i$ and up-dated $\eta_{add}$ and $k_{add}$ using the new frequency to calculate the more accurate added damping ratio $\zeta_{add}$. This iteration is continued until the calculated $\zeta_{add}$ is similar to the previous value within a preset tolerance.

While this invention has been described in connection with specific embodiments, it should be understood that it is capable of further modification. The claims herein are intended to cover those variations which one skilled in the art would recognize as the equivalent of what has been described herein.

It is claimed:

1. A method of damping floor vibrations comprising a step of attaching at least one article between a structural floor (A) of a structure at a location identified as a floor attachment location, and at least two locations on the structure identified as anchor attachment locations, wherein each anchor attachment location is independently selected from the group consisting of locations on (a) structural beams; (b) structural columns, (c) structural beam(s)/structural column intersection(s); (d) area(s) of a ground floor which are within about one meter of a structural column and/or structural beam; and (e) area(s) of a structural floor which are within about one meter of a structural column and/or beam, wherein the structural floor of (e) may or may not be the same structural floor as the structural floor (A), wherein each article is positioned beneath the structural floor (A) which it is to damp;

wherein each article independently comprises:

(i) two outer rigid members;

(ii) at least one layer of a vibration damping material bonded between the two outer rigid members;

wherein said outer rigid members have shear moduli greater than the vibration damping material layer(s); and wherein each article is constructed and attached to the structure such that the article at least partially dissipates vertical floor vibration energy when the structural floor (A) vibrates.

2. The method of claim 1 wherein the number of anchor attachment locations for each article ranges from two to four.

3. The method of claim 1 wherein the number of anchor attachment locations for at least one article is four.

4. The method of claim 1 wherein the anchor attachment locations are independently selected from the group consisting of structural beams, structural columns, and structural beam(s)/structural column intersections.

5. The method of claim 1 wherein the anchor attachment locations are independently selected from the group consisting of structural beam(s)/structural column intersections.

6. The method of claim 1 wherein the floor attachment location for at least one article is substantially centrally located within structural floor (A).

7. The method of claim 1 wherein each anchor attachment location is independently selected from the group consisting of (b) structural columns and (e) areas of a structural floor which are within about one meter of a structural column and/or beam, wherein the structural floor of (e) is the same structural floor as structural floor (A).

8. The method of claim 1 wherein the floor attachment location and at least two of the anchor attachment locations for at least one article fall on a straight line when viewed from a position directly above the floor attachment location.

9. The method of claim 1 wherein for at least one article the article further comprises one or more inner rigid members, positioned interior to the outer rigid members, wherein each rigid member in the article is separated from another rigid member by at least one layer of vibration damping material to which it is bonded wherein said inner rigid member(s) have shear moduli greater than the vibration damping material layer(s); and two or more alternating rigid members of the article are attached via a rigid connecting piece which does not extend through any vibration damping material layer.

10. The method of claim 1, wherein for at least one article the article further comprises one or more inner rigid members, positioned interior to the outer rigid members, wherein each rigid member in the article is separated from another rigid member by at least one layer of vibration damping material to which it is bonded wherein said inner rigid member(s) have shear moduli greater than the vibration damping material layer(s); and the total number of outer rigid members plus inner rigid members of the article is four or greater, wherein the rigid members of the article can be identified as a first alternating series of odd-numbered rigid members and a second alternating series of even-numbered rigid members and wherein one or both of the following of (i) and (ii) is true:

(i) two or more alternating rigid members of the first odd-numbered series are attached to each other along a first end of the article via a first rigid connecting piece, which first rigid connecting piece does not extend through any vibration damping material layer;

(ii) two or more alternating rigid members of the second even-numbered series are attached to each other along a second end of the article via a second rigid connecting piece, which second rigid connecting piece does not extend through any vibration damping material layer, wherein the second end of the article is positioned opposite the first end of the article.

11. The method of claim 9 wherein each article is attached to each anchor attachment location and the floor attachment location via a separate rigid attaching element, wherein each rigid attaching element is attached directly to a rigid member of the article or to a rigid connecting piece which connects two or more alternating rigid members of the article.

12. The method of claim 10 wherein each article is attached to each anchor attachment location and the floor attachment location via a separate rigid attaching element, wherein each rigid attaching element is attached directly to a rigid member of the article or to a rigid connecting piece.

13. The method of claim 10 wherein each rigid attaching element which attaches the article to the anchor attachment locations is attached to a rigid connecting piece on one side of the article and each rigid attaching element which attaches the article to the floor attachment location is attached to a rigid connecting piece on the opposite side of the article.

14. The method of claim 11 wherein the rigid attaching elements are selected from the group consisting of straight, curved, and angled rigid attaching elements.

15. The method of claim 11 wherein the rigid attaching elements which attach the article to anchor attachment locations are selected from the group consisting of curved and angled rigid attaching elements.

16. The method of claim 1 wherein the structure is selected from the group consisting of parking ramps, shopping malls, dwellings, office buildings, hospitals, airport terminals, stores, stadiums, arenas, theaters, schools, gymnasiums, dance halls, commercial office buildings, manufacturing plants, and platforms.

17. A damped structure comprising:

a structure having at least one article attached between a structural floor (A) of the structure at a location identified as a floor attachment location, and at least two locations on the structure identified as anchor attachment locations, wherein each anchor attachment location is independently selected from the group consisting of locations on (a) structural beams, (b) structural columns, (c) structural beam(s)/structural column intersection(s); (d) area(s) of a ground floor which are within about one meter of a structural column and/or structural beam; and (e) area(s) of a structural floor which are within about one meter of a structural column and/or structural beam, wherein the structural floor of (e) may or may not be the same structural floor as the structural floor (A), wherein each article is positioned beneath the structural floor (A) which it is to damp;

wherein each article independently comprises:

(i) two outer rigid members;

(ii) at least one layer of a vibration damping material bonded between the two outer rigid members;

wherein said outer rigid members have shear moduli greater than the vibration damping material layer(s);

wherein each article is constructed and attached to the structure such that the article at least partially dissipates vertical floor vibration energy when the structural floor (A) vibrates.

18. The damped structure of claim 17 wherein the number of anchor attachment locations for each article ranges from two to four.

19. The damped structure of claim 17 wherein the number of anchor attachment locations for at least one article is four.

20. The damped structure of claim 17 wherein the anchor attachment locations are independently selected from the group consisting of structural beams, structural columns, and structural beam(s)/structural column intersections.

21. The damped structure of claim 17 wherein the anchor attachment locations are independently selected from the group consisting of structural beam(s)/structural column intersections.

22. The damped structure of claim 17 wherein the floor attachment location for at least one article is substantially centrally located within structural floor (A).

23. The damped structure of claim 17 wherein each anchor attachment location is independently selected from the group consisting of (b) structural columns and (e) areas of a structural floor which are within about one meter of a structural column and/or beam, wherein the structural floor of (e) is the same structural floor as structural floor (A).

24. The damped structure of claim 17 wherein the floor attachment location and at least two of the anchor attachment locations for at least one article fall on a straight line when viewed from a position directly above the floor attachment location.

25. The article of claim 17 wherein for at least one article the article further comprises one or more inner rigid members, positioned interior to the outer rigid members, wherein each rigid member in the article is separated from another rigid member by at least one layer of vibration damping material to which it is bonded wherein said inner rigid member(s) have shear moduli greater than the vibration damping material layer(s); and two or more alternating rigid members of the article are attached via a rigid connecting piece which does not extend through any vibration damping material layer.

26. The damped structure of claim 17, wherein for at least one article the article further comprises one or more inner rigid members, positioned interior to the outer rigid members wherein each rigid member in the article is separated from another rigid member by at least one layer of vibration damping material to which it is bonded wherein said inner rigid member(s) have shear moduli greater than the vibration damping material layer(s); and the total number of outer rigid members plus inner rigid members of the article is four or greater, wherein the rigid members of the article can be identified as a first alternating series of odd-numbered rigid members and a second alternating series of even-numbered rigid members and wherein one or both of the following of (i) and (ii) is true:

(i) two or more alternating rigid members of the first odd-numbered series are attached to each other along a first end of the article via a first rigid connecting piece, which first rigid connecting piece does not extend through any vibration damping material layer;

(ii) two or more alternating rigid members of the second even-numbered series are attached to each other along a second end of the article via a second rigid connecting piece, which second rigid connecting piece does not extend through any vibration damping material layer, wherein the second end of the article is positioned opposite the first end of the article.

27. The damped structure of claim 25 wherein each article is attached to each anchor attachment location and the floor attachment location via a separate rigid attaching element, wherein each rigid attaching element is attached directly to a rigid member of the article or to a rigid connecting piece which connects two or more alternating rigid members of the article.

28. The damped structure of claim 26 wherein each article is attached to each anchor attachment location and the floor attachment location via a separate rigid attaching element, wherein each rigid attaching element is attached directly to a rigid member of the article or to a rigid connecting piece.

29. The damped structure of claim 26 wherein each rigid attaching element which attaches the article to the anchor attachment locations is attached to a rigid connecting piece on one side of the article and each rigid attaching element which attaches the article to the floor attachment location is attached to a rigid connecting piece on the opposite side of the article.

30. The damped structure of claim 27 wherein the rigid attaching elements are selected from the group consisting of straight, curved, and angled rigid attaching elements.

31. The damped structure of claim 27 wherein the rigid attaching elements which attach the article to anchor attachment locations are selected from the group consisting of curved and angled rigid attaching elements.

32. The damped structure of claim 17 wherein the structure is selected from the group consisting of parking ramps, shopping malls, dwellings, office buildings, hospitals, airport terminals, stores, stadiums, arenas, theaters, schools, gymnasiums, dance halls, commercial office buildings, manufacturing plants, and platforms.

33. The damped structure of claim 17 wherein the vibration damping material comprises a viscoelastic material.

34. The damped structure of claim 17 wherein each article independently is selected from the group consisting of shear dampers and tension-compression dampers.

35. The damped structure of claim 17 wherein each article is a shear damper.

36. The method of claim 1 wherein the vibration damping material comprises a viscoelastic material.

37. The method of claim 1 wherein each article is independently selected from the group consisting of shear dampers and tension-compression dampers.

38. The method of claim 1 wherein each article is a shear damper.

* * * * *